US007133328B2

(12) United States Patent
Cleusix et al.

(10) Patent No.: US 7,133,328 B2
(45) Date of Patent: Nov. 7, 2006

(54) LARGE DATE DISPLAY DEVICE

(75) Inventors: Willy Cleusix, Corcelles (CH); Norbert Perucchi, Saint-Blaise (CH)

(73) Assignee: DE Grisogono, Plan-Les-Ouates (CH)

( * ) Notice: Subject to any disclaimer, the term of this patent is extended or adjusted under 35 U.S.C. 154(b) by 0 days.

(21) Appl. No.: 11/167,402

(22) Filed: Jun. 27, 2005

(65) Prior Publication Data

US 2005/0286348 A1 Dec. 29, 2005

(30) Foreign Application Priority Data

Jun. 28, 2004 (EP) ..... 04405399

(51) Int. Cl.
*G04B 19/20* (2006.01)
*G94B 19/24* (2006.01)

(52) U.S. Cl. ..... 368/28; 368/37

(58) Field of Classification Search ..... 368/28, 368/35, 37, 38

See application file for complete search history.

(56) References Cited

U.S. PATENT DOCUMENTS

| | | | | |
|---|---|---|---|---|
| 3,818,689 | A | 6/1974 | Muller | |
| 3,879,929 | A * | 4/1975 | Charbonney et al. | 368/38 |
| 3,982,388 | A | 9/1976 | Guyot et al. | |
| 4,063,411 | A * | 12/1977 | Murrle | 368/221 |
| 4,427,300 | A | 1/1984 | Groothuis | |
| 6,738,316 | B1 * | 5/2004 | Gabathuler et al. | 368/28 |
| 6,958,952 | B1 * | 10/2005 | Gabathuler et al. | 368/28 |
| 7,031,227 | B1 * | 4/2006 | Huter | 368/37 |
| 2002/0159337 | A1 | 10/2002 | Weissbach et al. | |

FOREIGN PATENT DOCUMENTS

| | | |
|---|---|---|
| CH | 316461 | 10/1956 |
| CH | 688671 | 1/1998 |
| EP | 0218926 | 4/1987 |
| EP | 0515607 | 12/1992 |
| EP | 0529191 | 3/1993 |
| EP | 0537515 | 4/1993 |
| EP | 0940833 | 9/1999 |
| EP | 1070996 | 1/2001 |
| EP | 1296204 | 3/2003 |
| EP | 1369753 | 12/2003 |
| GB | 2345352 | 7/2000 |
| WO | WO 02052356 | 7/2002 |

OTHER PUBLICATIONS

Search Report for European Patent Application No. 04405399 mailed Jan. 25, 2005.

* cited by examiner

*Primary Examiner*—Vit W. Miska
(74) *Attorney, Agent, or Firm*—Kirkpatrick & Lockhart Nicholson Graham LLP

(57) ABSTRACT

Date system for a horological movement comprising a tens disc (2) connected to a star wheel (4) driven by a first drive device (12), and a units disc (1) driven by a second drive device (13). The said drive devices (12, 13) are connected to a rocker (9) which works with cams (10, 11) connected to a driving runner (5), which effects one rotation per month. These cams (10, 11) are provided with a tooth (20) and a notch (21) which keep the first drive device (12) in the disengaged position until the tooth (20) and the notch (21) actuate the said rocker (9) in order to engage and disengage the respective drive devices (12, 13) in such a way as to move the display from the $31^{st}$ to the $1^{st}$ of the month without an error of one day between the date indicated and the actual date.

9 Claims, 5 Drawing Sheets

LARGE DATE DISPLAY DEVICE

The present invention relates to horology, more particularly a mechanism for displaying a large date by means of a units disc and a tens disc in which the said discs are driven via a device using cams and a rocker.

A multitude of mechanisms for large date displays already exist. With this type of display it is possible to increase the size of the figures because it uses a combination of the tens figures with the units figures. With these large date mechanisms the date is therefore easier to read than with systems containing a single date disc, and yet the size is still moderate, which keeps the calibre reasonable.

There are already systems belonging to the prior art which provide for a large date display by means of a units disc and a tens disc.

A device of this kind is disclosed in document GB 2 345 352 A. Such a device allows the tens disc to advance one step and keeps the units disc between the last day of the month and the first day of the next month using cam systems which thus prevent an error of one day between the date indicated and the actual date. This is a simple date device. Such a device has an instantaneous mechanism, necessitating a complex system consisting of several levers and springs.

The object of the present invention is to provide a relatively compact and simple system for a large date display in order to allow an off-centre positioning of the said device with respect to the basic movement.

For this purpose the invention provides a simple horological date display mechanism using a mechanism comprising a cam system which, by means of a rocker, operates two drive devices working with the tens disc and the units disc. The profiles of the cams have been defined to ensure that the date advances from the 31st to the 1st of the succeeding month.

In contrast to document GB 2 345 352 A, this device possesses a semi-instantaneous mechanism which has only one rocker and simplifies the movement.

Other features of the invention are disclosed in the claims and appear in the description which follows.

An embodiment of the invention will now be described as an example with reference to the diagrammatic figures, in which.

Figure 1:
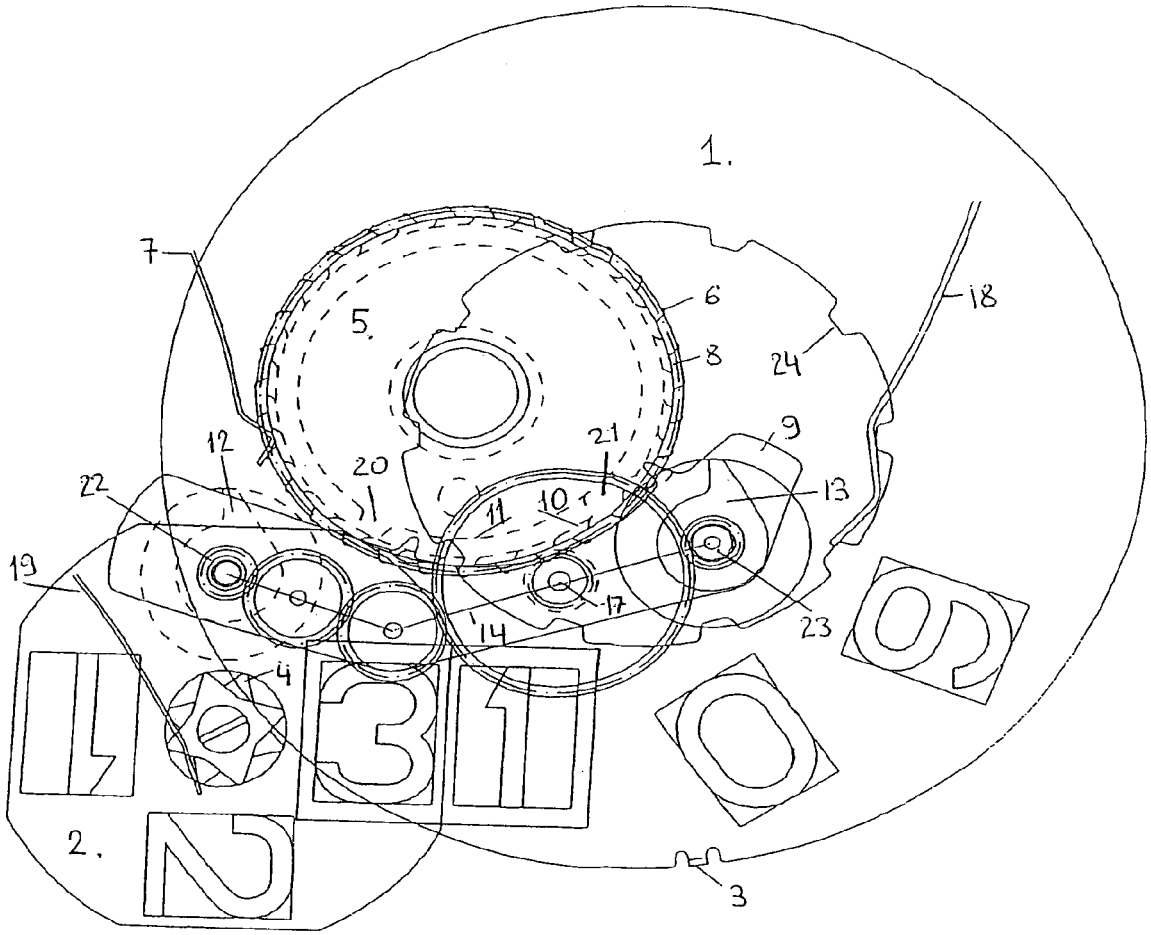
FIG. 1 is a plan view of the large date display device, showing the 31st of the month, immediately prior to the sequence of movements triggered by the cams and the rocker.
Figure 2:
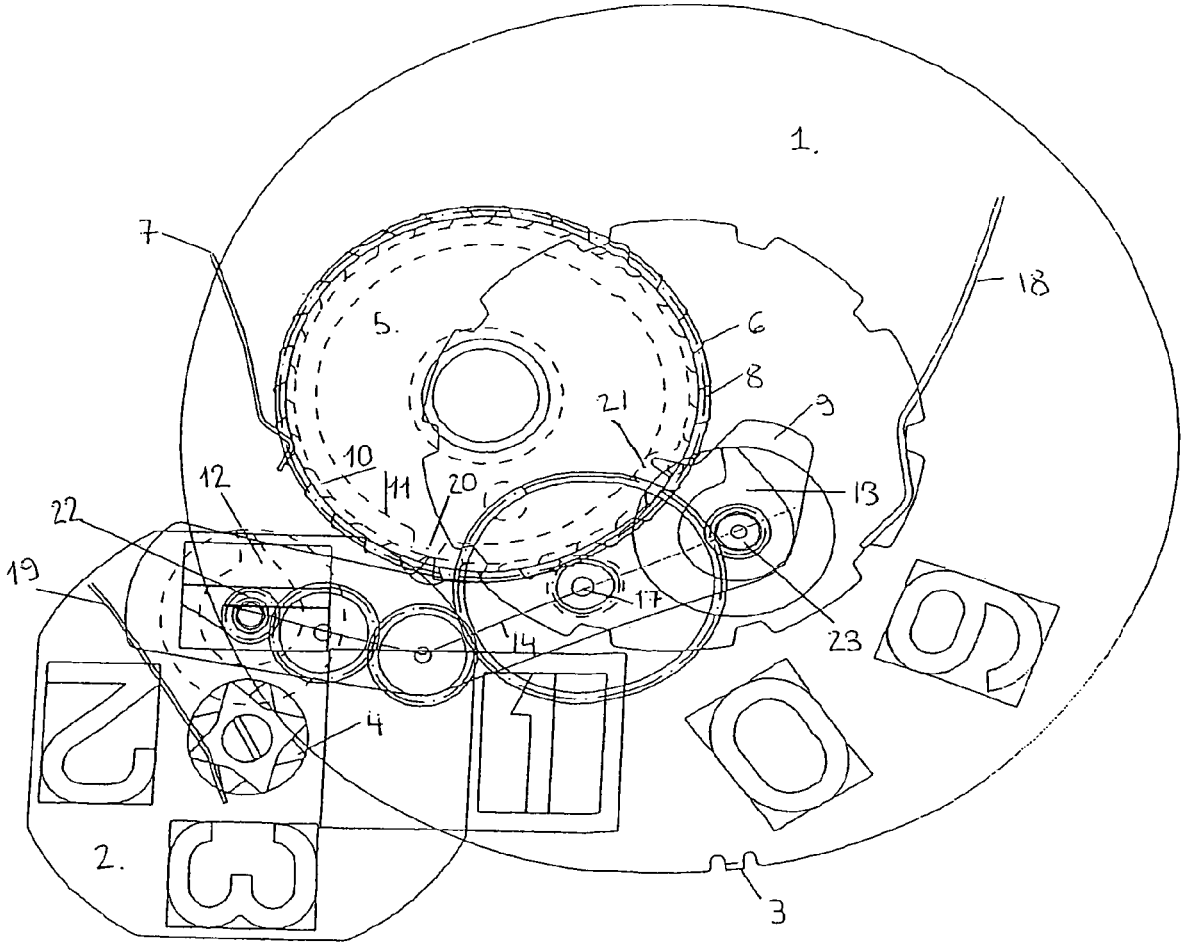
FIG. 2 is a plan view of the large date display device, showing the first day of the month immediately following the sequence of movements triggered by the cams and the rocker.

The embodiment of a horological movement for a simple date system according to the invention comprises:

- a units disc (1) which comprises internal teeth (24), is divided up into 10 segments and is held in the rest position by a jumper spring (18); this disc has one tooth (3);

- a tens disc (2) connected to a star wheel (4) driven by the said tooth (3) once per revolution in order to drive the disc (2) through one step every 10 days.

Figure 5:
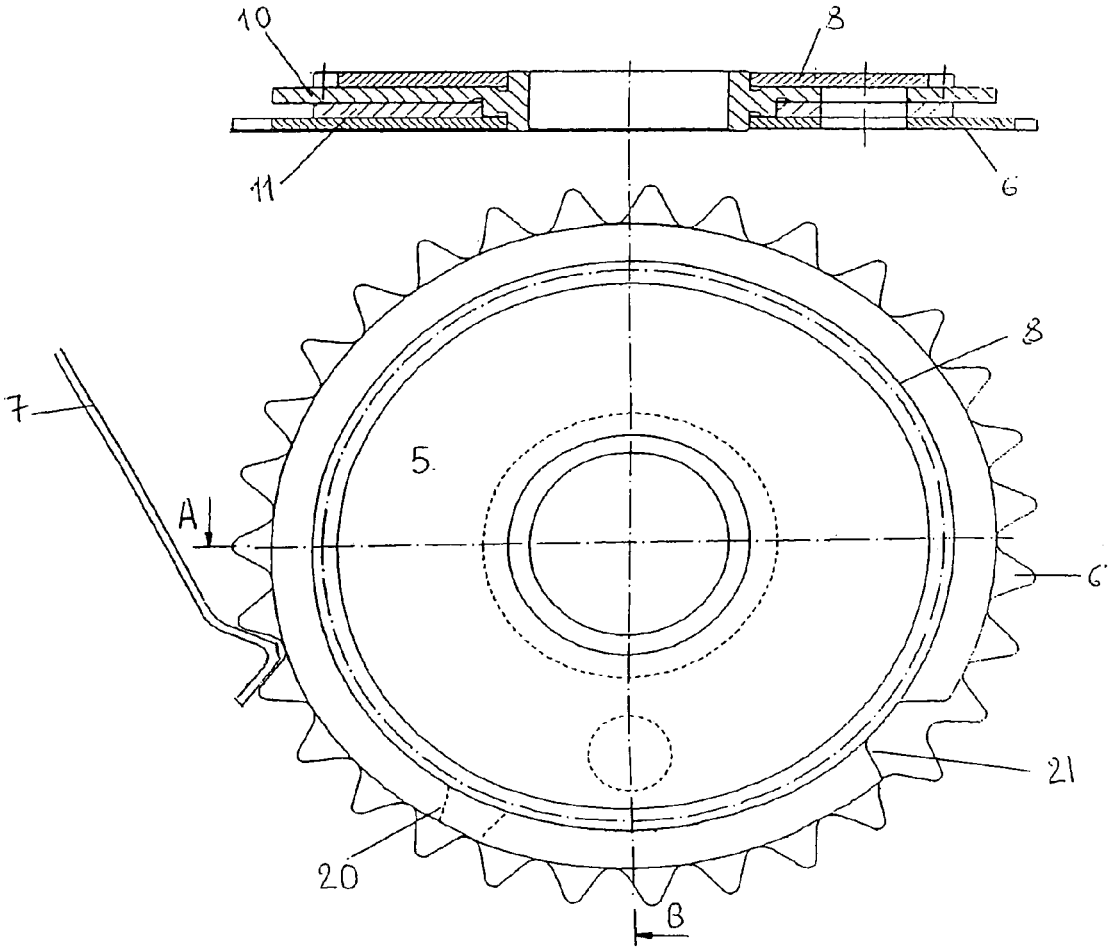
FIG. 5 is a plan view and sectional view taken on the line A–B of the driving runner.

The driving runner (5) (FIG. 5) comprises:

- a wheel (6) with 31 teeth, positioned by a jumper spring (7) and actuated by the basic movement;
- a wheel (8) connected to the driving runner (5) and describing one revolution every month;
- two cams (10, 11) connected to the driving runner comprising one tooth (20) and one notch (21).

Figure 4:
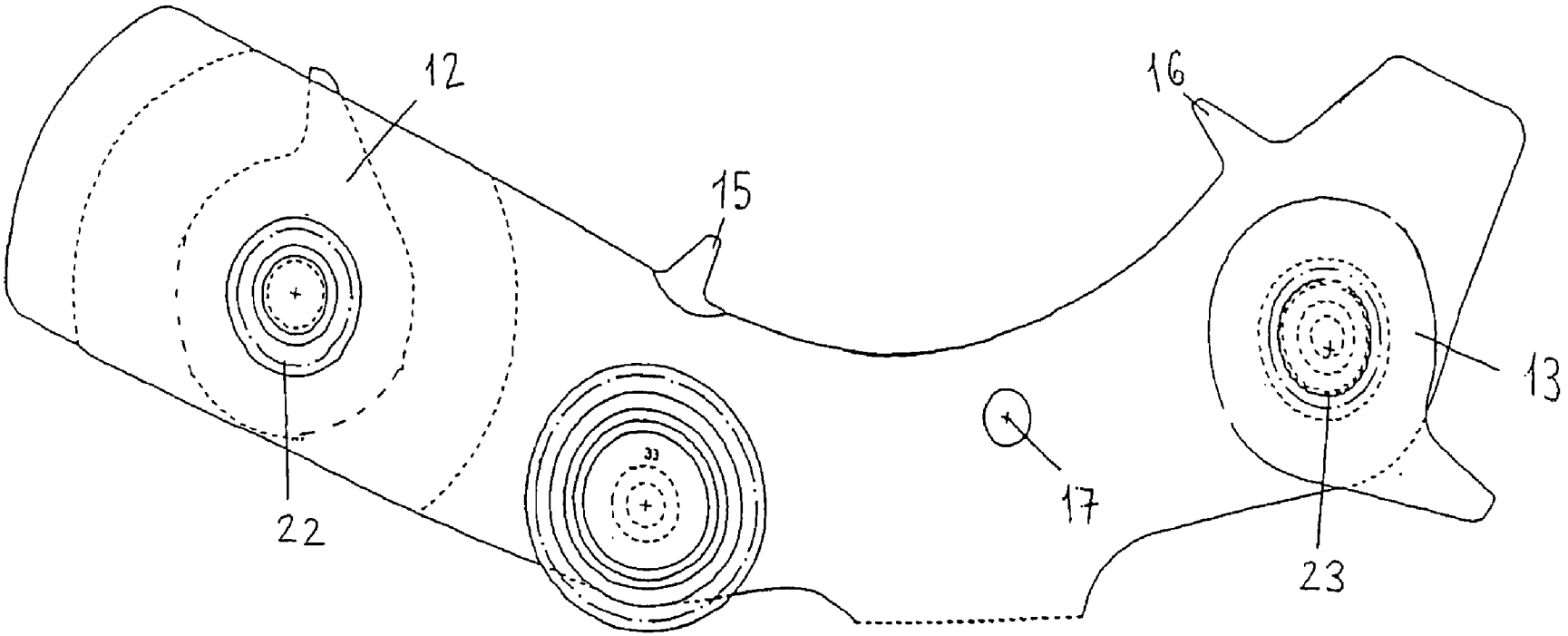
FIG. 4 is a plan view of a rocker provided with two fixed fingers which work with the cams of the driving runner and to which the two drive devices are connected.

The two cams (10, 11) work with a rocker (9) (FIG. 4) which comprises:

- two drive systems (12, 13) designed to rock, through one step, on the one hand the units disc (1) every day, and on the other hand the tens disc (2) at the end of each month;
- a wheel train (14), illustrated diagrammatically;
- two fixed fingers (15, 16) which work with the profiles of the cams (10, 11).

The drive device (12) of the star wheel (4) is positioned on the underside of the rocker and pressed onto the post of a pinion (22) which meshes with the wheel train (14). The drive device (13) is positioned on top of the rocker (9) and pressed onto the post of a pinion (23) which also meshes with the wheel train (14). The said pinions (22, 23) rotate on their axes due to the driving of the said wheel train.

The rocker (9), which comprises two bent arms, pivots about its axis (17), thus producing a rocking movement at its ends.

When the device indicates the last day of the month, that is 31, the following sequence of movements is set off:

- the fixed fingers (15, 16) of the rocker (9) fit the contour of the tooth (20) of the cam (10) and of the notch (21) of the cam (11), causing the said rocker to change position;
- the drive device (12) engages and meshes with the star wheel (4);
- at the same instant the drive device (13) comes away from the units disc (1);
- the drive device (12) disengages itself from the star wheel (4), and the star wheel (4) advances one step under the action of the jumper spring (19); and
- at the same instant the drive device (13) returns to its initial position and can continue to mesh with the units disc (1) for the rest of the month.

This arrangement carries the mechanism from the $31^{st}$ to the $1^{st}$ of the succeeding month and thus avoids an error of one day between the date indicated and the actual date. In other words, on the $31^{st}$ of the month the units disc is already displaying 1, so by disconnecting the drive device (13) from the units disc (1) alone, the tens disc is engaged, causing it to show the FIG. 0. Thus the date 01 is displayed.

Furthermore, the rocker (9) is provided with a wheel train meshing with two pinions (22, 23) connected to the drive devices (12, 13) positioned at each end of the said wheel train, thus ensuring adequate rotation of the said drive devices (12, 13).

The rotation of the drive devices (12, 13), which advance the units disc (1) one step every day, and the tens disc (2) one step on the $31^{st}$ of each month, respectively, is effected by the said wheel train (14).

Figure 3:
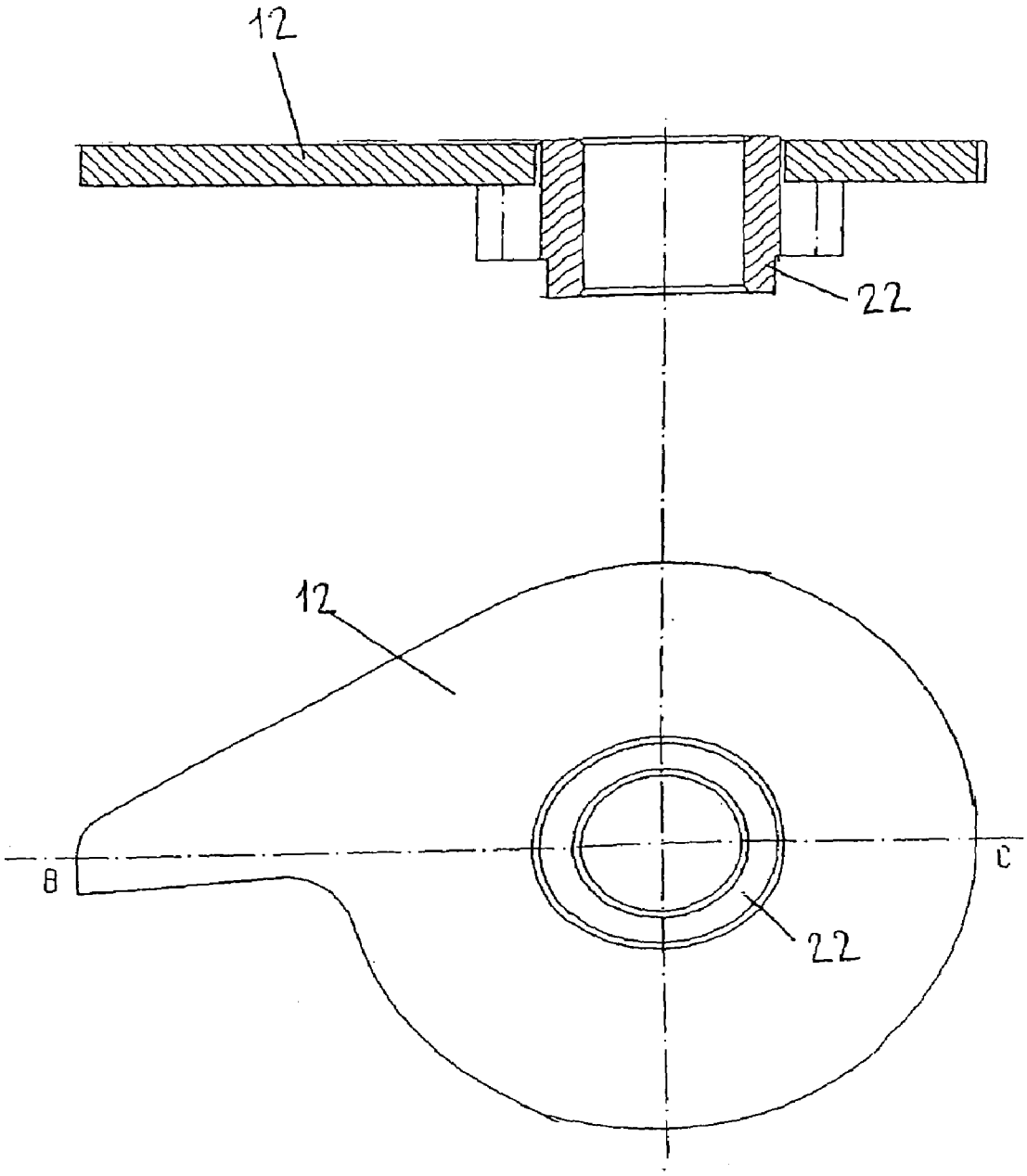
FIG. 3 is a plan view and sectional view taken on the line B–C of one of the two drive devices pressed onto a pinion which meshes with a wheel train.

One embodiment of the drive devices (12, 13) of the present invention is symbolized in FIG. 3. These devices may have one or more fingers depending on how much demultiplication is necessary.

The embodiment is not restrictive in any way, and the rocker (9) and drive devices (12, 13) may consequently take any other form provided the rocking action occurs in the manner described above. In one embodiment, the drive devices (12, 13) are provided with three projections at angles of 120° to each other.

The invention claimed is:

1. Date system for a horological movement comprising a tens disc (2) connected to a star wheel (4) driven by a first drive device (12), and a units disc (1) driven by a second drive device (13), which system is characterized in that the said drive devices (12, 13) are connected to a rocker (9) which works with cams (10, 11) connected to a driving runner (5), the said cams having respective profiles (20, 21) that keep the first drive device (12) disengaged from the star wheel (4) until the profile of one cam (10) and the profile of another cam (11) actuate the said rocker in order to engage and disengage the respective drive devices (12, 13) in such a way as to move the display from the $31^{st}$ to the $1^{st}$ of the month without an error of one day between the date indicated and the actual date.

2. Device according to claim 1, characterized in that the driving runner (5) executes one complete rotation per month.

3. Device according to claim 2, characterized in that a wheel train (14) connected to the driving runner (5) rotates the drive devices (12, 13) in order to drive the star wheel (4) connected to the tens disc (2) on the $31^{st}$ of the month, and the units disc (1) every day, respectively.

4. Device according to claim 1, characterized in that the profile of the cam (10) comprises a tooth (20) and the profile of the cam (11) comprises a notch (21).

5. Device according to claim 1, characterized in that the drive devices (12, 13) are of a shape comprising one or more projections so as to give a demultiplication suitable for the date system of a horological movement.

6. Device according to claim 5, characterized in that the drive devices (12, 13) are provided with three projections at angles of 120° to each other.

7. Device according to claim 1, characterized in that the rocker (9) possesses two separate fixed fingers (15, 16) working with the cams (10, 11).

8. Device according to claim 1, characterized in that the wheel train (14) is connected to the rocker (9).

9. Device according to claim 1, characterized in that the rocker (9) pivots about an axis (17) so as to bring about a rocking movement of the ends of the said rocker (9).

* * * * *